United States Patent [19]

Belvedere

[11] Patent Number: 4,733,624

[45] **Date of Patent: * Mar. 29, 1988**

[54] FLEXIBLE WING RIB SAIL

[75] Inventor: Mark S. Belvedere, Reseda, Calif.

[73] Assignee: Worldly Innovations, Inc., Cupertino, Calif.

[ * ] Notice: The portion of the term of this patent subsequent to Mar. 17, 2004 has been disclaimed.

[21] Appl. No.: 905,675

[22] Filed: Sep. 9, 1986

Related U.S. Application Data

[63] Continuation of Ser. No. 591,435, Mar. 20, 1984, Pat. No. 4,649,848.

[51] Int. Cl.[4] ..... B63H 9/06

[52] U.S. Cl. ..... 114/103; 114/90; 114/102; 114/98; 114/39.1

[58] Field of Search ..... 114/102–104, 114/39, 90, 108, 97–99; 441/74

[56] References Cited

U.S. PATENT DOCUMENTS

| | | | |
|---|---|---|---|
| 721,286 | 2/1903 | Couch | 114/103 |
| 2,561,253 | 7/1951 | Wells-Coates | 114/112 |
| 2,569,318 | 9/1951 | Kersten | 114/90 |
| 3,147,729 | 9/1964 | Barnard | 114/103 |
| 3,173,395 | 3/1965 | Laurent | 114/39 |
| 3,310,017 | 3/1967 | Dyer | 114/98 |
| 3,693,571 | 9/1972 | Hiscock | 114/102 |
| 3,768,426 | 10/1973 | Kratz | 114/39 |
| 3,877,406 | 4/1975 | Davis | 114/39 |
| 4,064,821 | 12/1977 | Roberts | 114/90 |
| 4,149,482 | 4/1979 | Hoyt | 114/106 |
| 4,230,060 | 10/1980 | McCoy | 114/39 |
| 4,267,790 | 5/1981 | Hood | 114/106 |
| 4,335,669 | 6/1982 | Hackney | 114/03 |
| 4,388,888 | 6/1983 | Gushurst | 114/90 |
| 4,479,451 | 10/1984 | Lucht | 114/104 |

FOREIGN PATENT DOCUMENTS

| | | | |
|---|---|---|---|
| 8400538 | 9/1985 | Netherlands | 114/103 |

OTHER PUBLICATIONS

"The Hi-Tension Wing Sail", by Jeff Magnan, Wind Surf, Jun. 1984, pp. 58–59.

"The Solid Wing", by Gary Efferdiny, Wind Surf, Jun. 1984, p. 59.

"Foils—Present & Future", Sailboarder, May 1984, by Barry Spanier and Goeffrey Bourne, pp. 22, 23.

"30k & Beyond", by Cliff Webb, *Wind Surf*, Mar. 1984, pp. 38–41, 79.

"Easy Rider" Sails, "Speed Line", Literature: Vertrieb, Hanover, West Germany.

North Sails Surf Advertisment, *Wind Surf*, Mar. 1984, p. 30.

"Sails—the Optimum Quiver", by Bill Whidden, Wind Surfer, May 1984, pp. 64–66.

"The Wing Mast: Vacuum Advance", by Clay Feeter, Wind Surfer, May 1984, p. 65.

"R & D Capers", by Roger Jones, Wind Surf, Jul. 1984, p. 70.

*Primary Examiner*—Joseph F. Peters, Jr.
*Assistant Examiner*—Clifford T. Bartz
*Attorney, Agent, or Firm*—Sheldon & Mak

[57] ABSTRACT

A sail on a cylindrical mast provides an aerodynamically shaped leading edge automatically oriented into relative wind, and a smooth shape behind the mast automatically adjusting for changes in trim of the sail. Flexible rib pairs opposite the mast are clamped tantentially to full length battens, the battens defining the shape of the ribs and the orientation of the leading edge.

17 Claims, 9 Drawing Figures

FLEXIBLE WING RIB SAIL

This is a continuation of application Ser. No. 591,435, filed Mar. 20, 1984, now U.S. Pat. No. 4,649,848 issued Mar. 17, 1987.

BACKGROUND

This invention relates to sailing vehicles such as boardsailing craft, and more particularly to the form and structure of the interface between a sail and a mast.

Conventional boardsailing technology is illustrated in FIG. 1 showing the leading edge of a sail wrapped around a cylindrical mast and attached thereto by a seam forming a pocket or sock for the mast. The seam forms a concave discontinuity on each side of the sail to the rear of the mast. These discontinuities induce turbulence which reduces the efficiency of the sail by increasing drag and decreasing lift generated by the sail. "Lift" herein means a force normal to both relative wind and the mast for propelling the vehicle produced by wind passing the sail leading edge proximate to the mast toward the sail trailing edge. "Drag" herein means a force normal to the lift and to the mast caused by resistance to relative wind passage over the mast and sail. Additional drag is produced with conventional technology because of the non-optimum cylindrical shape of the leading edge.

In this specification the terms "front", "top" and "head" refer respectively to upwind, lift and away from the vehicle directions. The directions "rear", "bottom" and "foot" are opposite to the respective "front", "top" and "head" directions respectively.

An improvement in the prior art is the use of an airfoil shaped mast as shown in FIG. 2. The front edge of the sail is supported by a bead engaging a slot in the rear of the mast. This design provides an efficient shape at the front of the mast, a relatively thin trailing edge at the rear of the mast and, when properly trimmed, a nearly continuously smooth shape on the top (low pressure) side of the sail at the rear of the mast.

The main disadvantage of the airfoil shaped mast is that the concave discontinuity on the bottom (high pressure) side is even greater than that formed by the conventional attachment described above when the curvature of the sail matches that of the rear top side of the mast.

Another disadvantage of the airfoil shaped mast is that turbulence will be generated on the top side unless the sail is trimmed to match the curvature of the top side of the mast at the point of attachment. Proper trim is illustrated in FIG. 2 by position (a) of the sail. In this position the curvature of the sail matches the curvature of the rear top side of the mast. When variant relative wind direction and/or velocity conditions are encountered, it may be desirable for overall sail performance to trim the sail to either position (b) or position (c) as shown in FIG. 2. The conditions illustrated by positions (b) or (c) produce the disadvantage of increased drag caused by turbulence at the rear of the mast due to a convex (position (b)) or concave (position (c)) discontinuity on the top side.

Another disadvantage of the airfoil shaped mast is that the conditions illustrated by positions (b) and (c) in FIG. 2 produce additional drag at the leading edge of the mast because the mast leading edge does not face properly into the relative wind.

To correct for the discontinuity at the top side between the airfoil shaped mast and the sail, and to align the leading edge into the relative wind, the prior art adds a further adjustment, that of rotating the mast. This added adjustment is costly to produce, subject to mechanical failure, and burdens a sailor with an additional function to monitor.

A further disadvantage of the prior art mast rotational adjustment is that the optimum position for matching sail curvature will not always position the leading edge directly into the relative wind.

In view of these problems there is a need for a sail attachment to a mast that provides an efficiently shaped, properly oriented,leading edge of the sail without introducing turbulence on either the top or bottom sides of the sail, and that is automatic in operation.

SUMMARY

The present invention is directed to a sail assembly that meets these needs. The sail assembly of the present invention forms an efficient leading edge properly aligned to the relative wind and a smooth aerodynamic contour behind both sides of a cylindrical mast, the shape automatically adjusting for changes in trim of the sail.

The assembly comprises a sail having a sock enclosing the mast and a main section with a trailing edge, the main section joining the sock at a sock seam, the sail including a plurality of batten pockets on the main section and extending freely with the sock to near the mast; a plurality of rib pocket pairs on the sock interrupting the seam opposite corresponding batten pockets; a leading edge member within the sock for defining an aerodynamic shape opposite the sock seam; a plurality of anchors fixedly fastened to the leading edge member for pivotably locating the leading edge member to the mast, the anchors being aligned with and fastened to the corresponding batten pockets; a plurality of battens in the corresponding batten pockets, the battens guided into fixed engagement with the anchors by the batten pockets, the battens extending proximately to the trailing edge of the sail; and a plurality of flexible rib pairs fastened tangent to the leading edge member on opposite sides of the mast and extending into the corresponding rib pocket pairs, the rib pocket pairs being slidably clamped by the rib pocket pairs substantially tangent to opposite sides of the corresponding battens, the assembly being adapted to automatically position the leading edge member into relative wind and to define a smooth aerodynamic shape of the sock blending with both sides of the main section as the sail is variously trimmed.

Preferably the rib pocket pairs extend parallel to the batten pockets on each side of the main section.

The present invention can be furnished as an attachment for a sail comprising a plurality of flexible rib pairs tangent to opposite sides of the mast to be slidably clamped near one end tangent to opposite sides of corresponding full length battens, the battens engaging anchors pivotably located by the mast, and an aerodynamically shaped leading edge member in front of the mast fastened to the rib pairs and to each anchor, the leading edge member being free to swivel with the anchors and the rib pairs about the mast.

A sail can be attached by forming a sock closely fitting the leading edge member with a sock seam aligned with desred points of tangency of the flexible rib pairs at the battens. To the sock seam is sewn a main portion of the sail including a trailing edge to the rear of the points of tangency. The sock can extend to the rear of the sock seam over each flexible rib pair to form a pair of rib pockets for slidably clamping the flexible rib pairs to the battens at the desired points of tangency. The seam is interrupted at the rib pockets to provide openings for the flexible rib pairs. The battens are located by conventional batten pockets to the rear of the seam and retained by conventional batten straps at the trailing edge. Preferably the batten pockets extend within the sock and attach to the anchors for guiding the battens into engagement with the anchors.

Pressure of the relative wind over the sail causes the leading edge and the flexible rib members to assume an efficient aerodynamic shape without turbulence inducing discontinuities on either side of the sail and with the leading edge properly facing into the relative wind.

Preferably the anchors have clearance to permit the flexible rib members to be inclined with respect to the mast so that the battens may also be inclined as dictated by sail design.

The leading edge member can be interrupted to provide a space within which to attach a conventional yoke to the mast.

Preferably the leading edge member is provided with a plurality of slots forming stops for locating the leading edge against the front of the mast. The leading edge member has notches opposite the slots to permit articulation conforming to flexing of the mast. The leading edge member can also be articulated into a coiled configuration to facilitate shipment.

Preferably the leading edge member is filled and reinforced with a low density material such as closed cell polyurethane foam.

Because of the pivotable aerodynamically leading edge and the flexible ribbed members clamped between the ends of full length battens for automatic control of a smooth contour on both sides of the sail, the attachment of the present invention satisfies the need for a sail attachment that provides an efficiently shaped leading edge of the mast facing into the relative wind without introducing turbulence on either the low pressure or high pressure sides of the sail, and that is automatic in operation.

DRAWINGS

These and other features, aspects, and advantages of the present invention will become better understood with reference to the following description, appended claims, and accompanying drawings where:

DESCRIPTION

Figure 1:
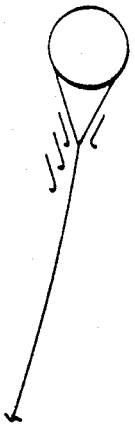
FIG. 1. PRIOR ART
FIG. 1 shows in lateral section a conventional prior art sail attachment.
Figure 2:
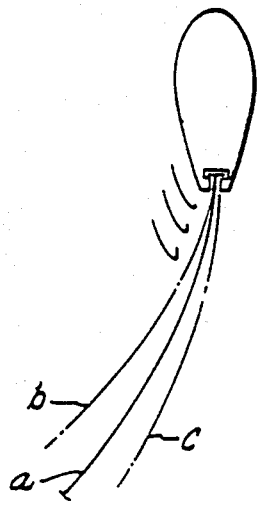
FIG. 2. PRIOR ART
FIG. 2 shows in lateral section a prior art sail attachment to an airfoil shaped mast.
Figure 8:
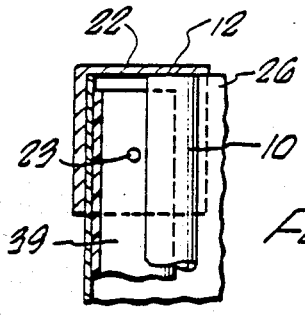
FIG. 8 is a detailed fragmentary sectional view of the attachment of FIG. 3 taken within the region 8—8 of FIG. 3.
Figure 3:
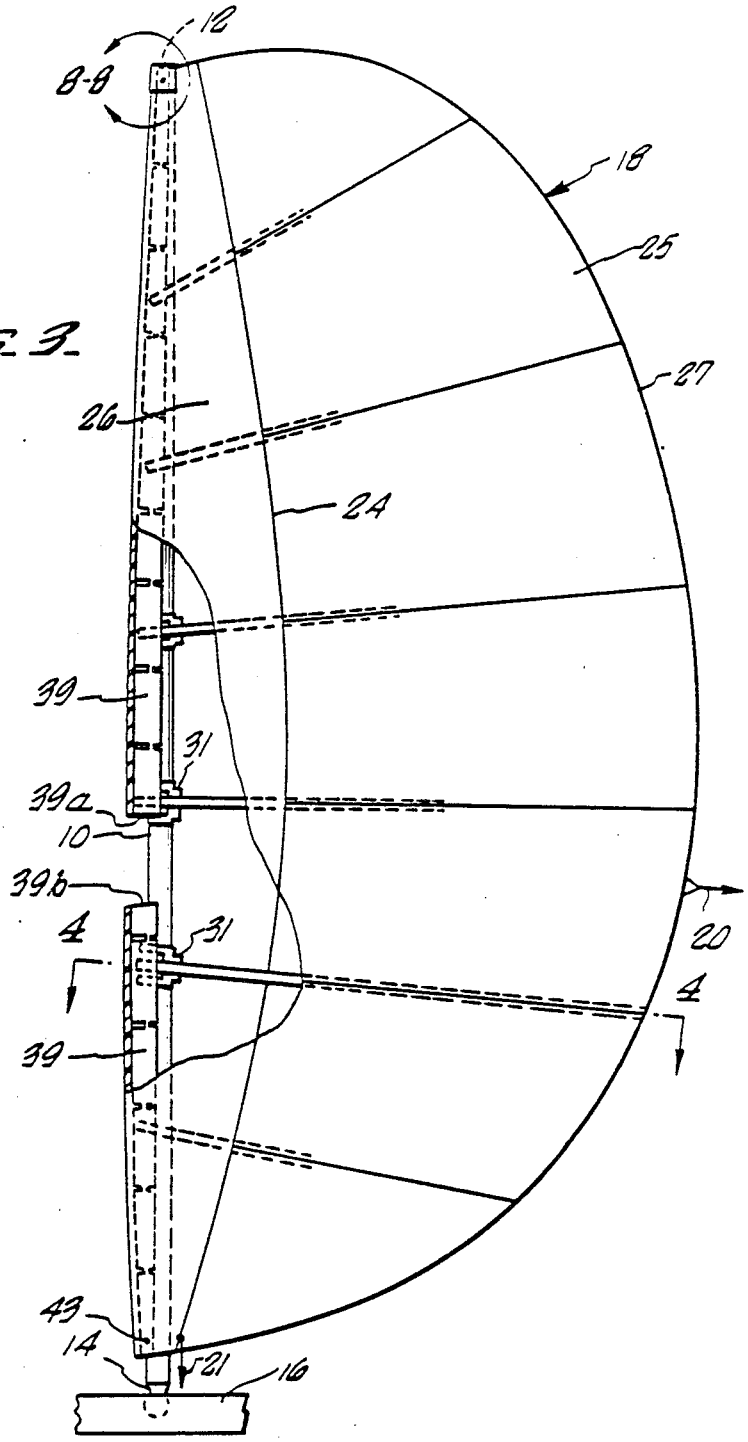
FIG. 3 is an elevational view of a sail employing the attachment according to the present invention, the attachment comprising a leading edge member interrupted to provide space to attach a conventional yoke (not shown) to the mast.

With reference to FIGS. 3 and 8, a cylindrical mast 10 having a tip 12 and a foot 14 is pivotably attached at the foot to a sailboard 16. A sail 18 attached to the mast 10 is equipped with an out-haul 20 fastened to a conventional yoke (not shown.) The sail 18 is also equipped with a conventional down-haul 21 proximate to the foot 14 for stretching the sail 18 against the tip 12. A conventional boot 22 is fastened to the sail 18 by a boot pin 23, the boot 22 engaging the tip 12 when tension is applied to the down-haul 21. A sock seam 24 in the sail 18 connects a main section 25 of the sail to a sock 26 enclosing the mast 10.

With reference to FIGS. 3–7, the sail 18 having a trailing edge 27 is equipped with a plurality of full length battens 28 which are conventionally located by corresponding batten pockets 29 on the main section 25, the battens 28 extending from corresponding conventional batten straps 30 on the trailing edge 27 to corresponding anchors 31. Each batten strap 30 stretches the sail 18 over the corresponding batten 28 when a batten loop patch 32 fastened to the batten strap 30 is engaged with a batten hook patch 33 fastened to the batten pocket 29. Each batten pocket 29 and a corresponding pocket extension 34 of the main section 25 extends to a point proximate to the corresponding anchor 31 for guiding the batten 28 into engagement with the anchor 31. An anchor strap 35 fastened to the pocket extension 34 secures the batten pocket 29 with the pocket extension 34 to the anchor 31 through a strap slot 36 in the anchor 31. An anchor loop patch 37 fastened to the anchor strap 35 engages an anchor hook patch 38 fastened to the batten pocket 29.

In front of the mast 10 within the sock 26 of the sail is located a leading edge member 39. The leading edge member 39 can be interrupted to form a head leading edge member 39*a* and a foot leading edge member 39*b* with space between for fastening a conventional yoke (not shown) to the mast 10. The head leading edge member 39*a* is retained axially within the sock 26 by the boot pin 23. The foot leading edge member 39*b* is retained axially within the sock 26 by a foot pin 43.

Figures 4, 5, 6, 7:
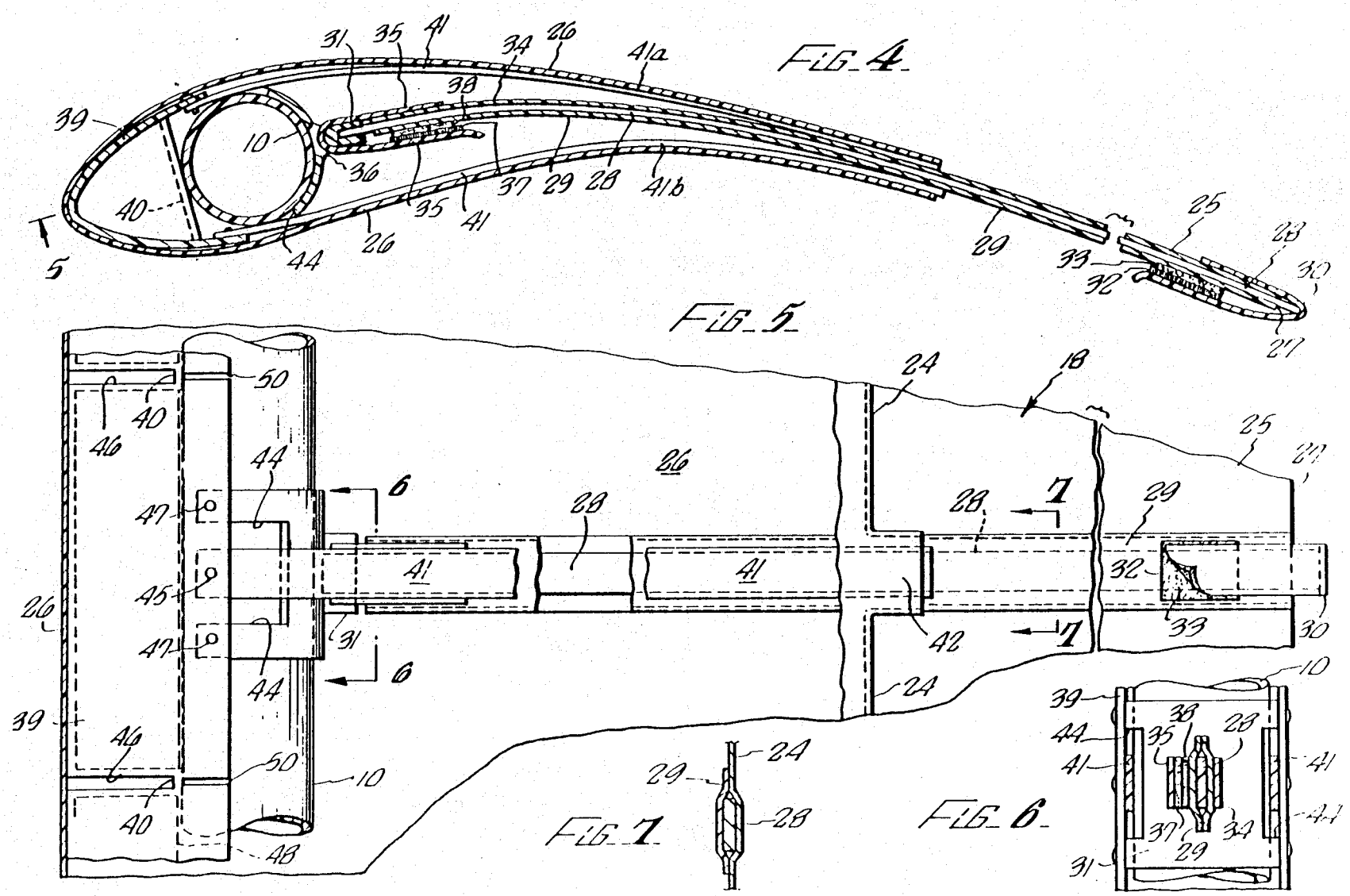
FIG. 4 is a lateral detailed sectional view of the attachment of FIG. 3 along the line 4—4 of FIG. 3.
FIG. 5 is a detail fragmentary sectional view of the attachment of FIG. 3 taken on line 5—5 in FIG. 4.
FIG. 6 is a detail fragmentary sectional view of the attachment of FIG. 3 taken on line 6—6 on FIG. 5.
FIG. 7 is a detail fragmentary sectional view of the attachment of FIG. 3 taken on line 7—7 on FIG. 5.

With reference to FIGS. 4 and 5, the leading edge member 39 is equipped with a plurality of stops 40 which rest against the mast 10. A plurality of flexible rib pairs 41 co-planar with corresponding battens 29 contact opposite sides of the mast 10 and are pivotably fastened tangent to the leading edge member 39 by a pair of rib rivits 45. Each flexible rib pair 41 extends beyond the sock seam 24 of the sail 18 and is slidably clamped tangent to opposite sides of the batten 28 by a pair of rib pocket extensions 42 in the sock 26. Each anchor 31 is shaped to be pivotably located by the mast 10, the anchor 31 having an anchor notch 44 to provide clearance for each rib of the flexible rib pairs 41. The anchor 31 is fixedly riveted to the leading edge member 39 by a plurality of anchor rivets 47. Thus, the leading edge member 39, anchor 31 and flexible rib pairs 41 are free to pivot as a unit about the mast 10 according to the orientation of the battens 28.

Preferably the clearance for the rib pairs 41 provided by the anchor notches 44 in the anchors 31 is sufficient to permit the flexible rib pairs 41 to assume positions substantially inclined from perpendicular to the mast 10. This clearance enables the battens 28 to be positioned substantially inclined as dictated by the design of the sail 18.

Preferably the stops 40 are formed by corresponding slot bulkheads 46 molded into the leading edge member 39. The configuration of the stops 40 and the slot bulkheads 46 permits the leading edge member 39 to be vacuum formed from sheet material.

Preferably the leading edge member 39 is reinforced by a filler 48 such as low density closed cell polyurethane foam, the filler 48 having desirable buoyancy such that an assembly including the sail 18 will float in water.

Figure 9:
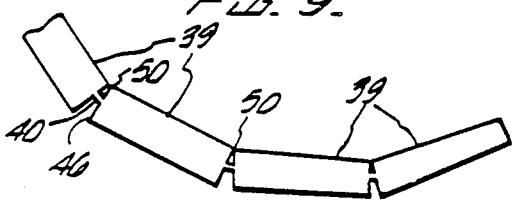
FIG. 9 shows articulation of the leading edge member of the attachment of FIG. 3 into a coil form to facilitate shipment.

Preferably the leading edge member 39 has slots 50 corresponding to each stop 40 so that the leading edge member 39 is segmented and can be articulated at each of the stops 40. Articulation of the leading edge members 39 permits the mast 10 to flex when in use. In addition, the leading edge member 39 can be arranged into a coiled configuration more convenient for shipping as shown in FIG. 9.

In another verson of the present invention the rib pocket extension 42 for slidably clamping the flexible rib pairs can be separate from the sock.

The attachment of the present invention can be assembled to the sail 18 in the following steps:

1. Inserting the head leading edge member 39*a* with the attached anchors 31 and the flexible rib pairs 41 partway into the sock 26, the flexible rib pairs 41 having been inclined to precede corresponding anchors 31 entering the sock section 26;

2. Guiding each flexible rib of the rib pairs 41 into the corresponding rib pocket extensions 42;

3. Continuing insertion of the leading edge member 39*a* completely into the sock 26;

4. Installing the boot 22 with the boot pin 23 engaging the boot 23, the sock 26 and the leading edge member 39*a;*

5. Repeating steps 1–3 for the foot leading edge member 39*b;*

6. Fastening the foot leading edge member 39*b* to the sock 26 with the foot pin 43;

7. Fastening the pocket extensions 34 with the batten pockets 29 to the anchors 31 by feeding the anchor straps 35 through the corresponding strap slots 36 in the anchors 31, then engaging the anchor loop patches 37 with the corresponding anchor hook patches 38;

8. Inserting the mast 10 between the stops 40 and the anchors 31 until the tip 12 engages the boot 23;

9. Inserting the battens 28 between the batten pockets 29 and the main section 25 at the trailing edge 27, into engagement with the anchors 31;

10. Fastening the batten straps 30 with the battens 28 in axial compression; and 11. Attaching the conventional yoke and connecting the down-haul 21 and the out-haul 20.

In operation, the shape and orientation of the battens 28 is defined by the location of the mast and the yoke and the pressure of wind against the sail. One rib 41*a* of each flexible rib pair 41 automatically assumes a smooth convex shape while the other rib 41*b* of each flexible rib pair 41 automatically assumes a smooth concave shape. Simultaneously, the anchors 31 are turned by the battens 28 to face the leading edge member 39 properly into the wind. The anchor straps 35 securing the batten pockets 29 to the anchors 31 assist the turning of the anchors 31 under tension in the batten pockets 29 at the anchors 31 reacting against compression of the battens 29 by the batten straps 30.

Although the present invention has been described in considerable detail in reference to certain preferred versions thereof, other versions are possible. For example, the flexible rib pairs 41 can be slidably clamped between the leading edge member 39 and opposite sides of the mast 10 and fixedly located with the rib pocket extensions 42. Therefore, the spirit and scope of the appended claims should not necessarily be limited to the description of the preferred versions contained herein.

What is claimed is:

1. A sail apparatus for attachment to a cylindrical mast, the apparatus comprising:

(a) a sail comprising a flexible sheet material having a sock portion for enclosing the mast, the sail also having a trailing edge and a main portion extending rearwardly thereto from a trailing end of the sock;

(b) a flexible batten for stiffening the sail, the flexible batten extending toward the trailing edge of the sail from a point within the sock;

(c) batten locating means for locating the forward end of the batten proximate the mast as the sail pivots around the mast; and (d) means for stiffening the sock to define a smooth aerodynamic shape of the sail, including the sock, the stiffening means comprising:

(i) a flexible rib member, the rib member extending from proximate the mast along one side of the sock;

(ii) rib locating means for locating a leading end of the rib member against a side of the mast;

(iii) means for holding a trailing end of the rib member against the batten proximate the trailing end of the sock, whereby the rib member in a portion thereof proximate the holding means is maintained proximately tangent to the batten and the direction of curvature of the rib member corresponds to the curvature of the batten as the batten flexes together with sail; and (iv) means for permitting the rib member to curve away from the batten between the holding means and the rib locating means.

2. The apparatus of claim 1 wherein the means for stiffening the sock includes a pair of the rib members on opposite sides of the batten.

3. The apparatus of claim 2 further comprising means for producing an axial compressive load in the batten against the batten locating means for rotating the rib locating means about the mast for inducing curvature of the rib members.

4. The apparatus of claim 1 wherein the stiffening means includes a leading edge member for defining a smooth aerodynamic shape ahead of the mast.

5. The apparatus of claim 1 wherein the batten locating means includes means for permitting lateral movement of the batten within the sock between the holding means and the forward end of the batten.

6. A sail apparatus for attachment to a cylindrical mast, the apparatus comprising:

(a) a sail having a flexible sock portion for flexibly enclosing the mast, the sail also having a trailing edge and a main portion extending rearwardly thereto from a trailing end of the sock;

(b) a flexible batten for stiffening the sail, the flexible batten extending toward the trailing edge of the sail from a point within the sock;

(c) batten locating means for locating the forward end of the batten proximate the mast as the sail pivots around the mast; and (d) means for stiffening the sock to define a smooth aerodynamic shape of the sail, including the sock, the stiffening means comprising:

(i) a flexible rib member, the rib member extending from the mast along one side of the sock;

(ii) rib locating means for locating a leading end of the rib member against one side of the mast;

(iii) means for holding a trailing end of the rib member substantially against the batten proximate the trailing end of the sock, whereby the rib member in a portion thereof proximate the holding means is maintained proximately tangent to the batten and with a degree of curvature corresponding to the curvature of the batten as the batten flexes together with the sail; and (iv) means for permitting the rib member to curve away from the batten between the holding means and the rib locating means.

7. The apparatus of claim 6 wherein the means for stiffening the sock includes a pair of the rib members on opposite sides of the batten, the rib locating means locating the leading ends of the rib members proximately tangent to the opposite sides of the mast.

8. The sail assembly of claim 7 further comprising means for producing a compressive load in the batten and means for inducing rotation of the rib locating means about the mast in response to flexing of the batten for flexing the rib members.

9. An apparatus for attaching a sail to a cylindrical mast of a vessel, the sail having a main portion with a trailing edge, and a sock for enclosing the mast, a sock seam joining the sock to the main portion, the apparatus comprising:

(a) a plurality of flexible battens for stiffening the sail, each batten extending from within the sock to proximate the trailing edge of the sail;

(b) a plurality of stiffeners for stiffening and shaping the sock, each stiffener comprising:

(i) a pair of flexible rib members, the rib members extending from the mast along opposite sides of the sock;

(ii) rib locating means for locating a leading end of each rib proximate opposite sides of the mast;

(iii) means for holding a trailing end of each rib member against opposite sides of the batten proximate the trailing end of the sock, whereby the rib members in portions thereof proximate the holding means are maintained proximately tangent to the batten and with a direction of curvature corresponding to the curvature of the batten as the batten flexes together with the sail; and (iv) means for permitting the rib members to curve away from the batten between the holding means and the rib locating means;

(c) means for clamping the battens between the corresponding pairs of rib members proximate the sock seam, the rib members being held substantially tangent to opposite sides of the corresponding battens; and (d) means for permitting relative movement between the rib members of each pair of the direction of the respective batten, wherein the apparatus defines a smooth aerodynamic shape of the sock blending with both sides of the main section as the sail is variously trimmed.

10. A sail apparatus for attachment to the mast and boom of a sail board, the boom being equipped with adjustable outhaul means, the assembly comprising:

(a) a flexible sail comprising:

(i) a sock portion for enclosing the mast, the sock portion having a trailing end; and (ii) a main portion extending from the trailing end of the sock and having a trailing edge, the sock allowing the entire sail to pivot around the mast;

(b) means for attaching the trailing edge of the sail to the outhaul means; and (c) a plurality of stiffeners for stiffening and shaping the sail, each stiffener comprising:

(i) a pair of flexible, spaced apart ribs in the sock for stiffening the sock, the ribs extending from proximate the mast to proximate the trailing end of the sock;

(ii) a flexible batten stiffening the sail, the flexible batten extending from within the sock, to proximate the trailing edge of the sail;

(iii) supporting means in the sock proximate the mast for supporting the ribs, the supporting means being capable of pivoting around the mast;

(iv) receiving means in the sock for receiving the batten;

(v) means for holding the trailing end of each rib adjacent to and parallel to the batten; and (vi) means for permitting the ribs to move relative to each other in the direction of the batten for defining a smooth flexible aerodynamic shape of the sail, including the sock, as the sail pivots around the mast.

11. The apparatus of claim 10 wherein the holding means comprises rib pocket means for the ribs on opposite sides of the batten proximate the trailing end of the sock.

12. The apparatus of claim 10 in which each stiffener comprises a rib pocket extending substantially the entire length of the ribs within the sock for conforming the shape of the sock to the shape of the ribs.

13. A sail board comprising:

(a) a board;

(b) a cylindrical mast attached to the board;

(c) a flexible sail comprising:

(i) a sock portion enclosing the mast, the sock portion having a trailing end; and (ii) a main portion extending from the trailing end of the sock and having a trailing edge, the sock allowing the entire sail to pivot around the mast;

(d) outhaul means attached to the trailing edge of the sail for locating the trailing edge of the sail; and (e) a plurality of stiffeners for stiffening and shaping the sail, each stiffener comprising:

(i) a pair of flexible, spaced apart ribs in the sock for stiffening the sock, the ribs extending from proximate the mast to proximate the trailing end of the sock;

(ii) a flexible batten stiffening the sail, the flexible batten extending from within the sock, the proximate the trailing edge of the sail;

(iii) supporting means in the sock proximate the mast for supporting the ribs, the supporting means being capable of pivoting around the mast;

(iv) receiving means in the sock for receiving the batten;

(v) means for holding the trailing end of each rib adjacent to and parallel to the batten; and (vi) means for permitting the ribs to move relative to each other in the direction of the batten for defining a smooth flexible aerodynamic shape of the sail, including the sock, as the sail pivots around the mast in response to the outhaul means.

14. The sailboard of claim 13 wherein the holding means comprises a pair of rib pockets on the sock, the ribs being in respective rib pockets.

15. The sailboard of claim 13 in which each stiffener comprises a batten pocket extending substantially the entire length of the sail with the batten therein, the batten pocket being substantially parallel to the rib pair.

16. A sail apparatus for attachment to a cylindrical mast, the assembly comprising:

(a) a sail comprising a flexible sheet material forming a sock for enclosing the mast and a main section with a trailing edge, the main section joining the sock at a sock seam;

(b) a plurality of stiffeners for stiffening and shaping the sock, each stiffener comprising:

(i) a leading edge member within the sock for defining an aerodynamic shape opposite the sock seam;

(ii) means for pivotably locating the leading edge member against the mast; and (iii) a pair of flexible rib members extending from the leading edge member on opposite sides of the mast to proximate the sock seam;

(c) a plurality of flexible battens for stiffening the sail, each batten extending from within the sock, between a corresponding pair of the rib members, proximately to the trailing edge of the sail;

(d) means proximate the sock seam for clamping the battens between the corresponding pairs of rib members, the rib members being held substantially tangent to opposite sides of the corresponding battens; and (e) means for permitting relative movement between the rib members of each pair in the direction of the respective batten, wherein the apparatus defines a smooth aerodynamic shape of the sock blending with both sides of the main section as the sail is variously trimmed.

17. A sail apparatus for attachment to a cylindrical mast, the apparatus comprising:

(a) a sail having a sock portion for flexibly enclosing the mast, the sail also having a trailing edge and a main portion extending rearwardly thereto from a trailing end of the sock;

(b) a flexible batten for stiffening the sail, the flexible batten extending toward the trailing edge of the sail from a point within the sock;

(c) batten locating means for locating the forward end of the batten proximate the mast as the sail pivots around the mast; and (d) means for stiffening the sock to define a smooth aerodynamic shape of the sail, including the sock, the stiffening means comprising:

(i) a pair of flexible rib members, the rib members extending from the mast along opposite sides of the sock;

(ii) rib locating means for locating a leading end of each rib proximate opposite sides of the mast;

(iii) means for holding a trailing end of each rib member against opposite sides of the batten proximate the trailing end of the sock, whereby the rib members in portions thereof proximate the holding means are maintained proximately tangent to the batten and with a direction of curvature corresponding to the curvature of the batten as the batten flexes together with the sail, the rib members defining a smoothly tapering flexible shape of the sock between the mast and the trailing end of the sock; and (iv) means for inducing the rib locating means to rotate about the mast in response to flexing of the batten.

* * * * *